US005327934A

United States Patent [19]

Thompson

[11] Patent Number: 5,327,934

[45] Date of Patent: Jul. 12, 1994

[54] AUTOMOTIVE FUEL TANK PRESSURE CONTROL VALVE

[75] Inventor: Robert H. Thompson, Redford, Mich.

[73] Assignee: Ford Motor Copany, Dearborn, Mich.

[21] Appl. No.: 72,637

[22] Filed: Jun. 7, 1993

[51] Int. Cl.[5] ..... F02M 33/02

[52] U.S. Cl. ..... 137/588; 123/519; 141/59

[58] Field of Search ..... 123/519; 141/59, 46, 141/302; 137/587, 588

[56] References Cited

U.S. PATENT DOCUMENTS

| | | | |
|---|---|---|---|
| 3,616,783 | 11/1971 | Masters | 123/136 |
| 4,040,404 | 8/1977 | Tagawa | 123/136 |
| 4,343,281 | 8/1982 | Uozumi et al. | 137/588 |
| 4,706,708 | 11/1987 | Fornuto et al. | 137/588 |
| 4,790,349 | 12/1988 | Harris | 137/587 |
| 4,951,637 | 8/1990 | Cook | 123/519 |
| 5,014,742 | 5/1991 | Covert et al. | 137/588 |
| 5,054,508 | 10/1991 | Benjey | 137/587 |
| 5,054,528 | 10/1991 | Saitoh | 141/59 |
| 5,099,880 | 3/1992 | Szlaga et al. | 137/587 |
| 5,103,877 | 4/1992 | Sherwood et al. | 141/59 |
| 5,215,132 | 6/1993 | Kobayashi | 141/302 |

*Primary Examiner*—A. Michael Chambers

*Attorney, Agent, or Firm*—David B. Kelley; Roger L. May

[57] ABSTRACT

A pressure control valve for controlling vapor pressure in a fuel tank has an inlet line from the fuel tank, a pressure sensing line from the filler pipe, and an outlet line to a canister for handling the fuel vapor. Fuel vapor flow through the valve is controlled by ambient pressure from the filler pipe and tank pressure from the fuel tank, with those pressures acting on two diaphragms within the valve to alternately allow flow through the valve during normal vehicle operation and to prevent flow during refueling. A pressure relief valve is connected between the filler pipe line and the canister outlet line to prevent tank overpressurization should the valve malfunction.

19 Claims, 1 Drawing Sheet

AUTOMOTIVE FUEL TANK PRESSURE CONTROL VALVE

FIELD OF THE INVENTION

The present invention pertains to vehicle fuel tank pressure control valves, and particularly to such valves designed to control vapor pressure in the fuel tank during refueling or other operation of the vehicle.

BACKGROUND OF THE INVENTION

Fuel inside a vehicle fuel tank regularly produces a vapor which collects above the fuel and, if not released, causes an increase in tank pressure. Control of this fuel vapor is necessary to prevent overfilling and overpressurization of the tank. In addition, environmental concerns and regulations dictate that the fuel vapor be controlled so that it does not escape to the atmosphere.

Several methods and devices have been used to control and recapture fuel vapor, most employing a carbon canister to trap the vapor. These devices differ mainly in the type of valve used to route the vapor to the carbon canister and the mechanism for triggering the valve. Many such valves are triggered by insertion of a fuel pump nozzle or by removal of the gas cap during refueling. These valves include, for example, a vacuum actuated piston vent valve (U.S. Pat. No. 5,014,742, Covert, et.al.), a solenoid assisted float valve (U.S. Pat. No. 5,054,528, Saitoh), a two-way valve (U.S. Pat. No. 4,343,281, Uozumi et.al.), and a check valve (U.S. Pat. No. 4,040,404, Tagawa).

The valve type disclosed in U.S. Pat. No. 5,099,880 (Szlaga et.al.) uses spring-biased diaphragm assemblies to maintain sufficient tank pressure during refueling to prevent overfill. The diaphragm assemblies are arranged such that fuel vapor remains in the tank while refueling, but is routed to a canister when the filler cap is replaced and tank pressure exceeds a preset value. Several chambers in the valve allow the diaphragm assemblies to route the fuel vapor to the canister. However, operation of such a valve will fail if an equalization orifice (for example, bleed passageway 56 in FIG. 1 of the '880 patent) between chambers on either side of a diaphragm becomes blocked. When equalization of pressure between chambers does not occur, opening of the diaphragm may be impeded, thus hindering the vapor flow from the tank to the canister. Tank pressure could then exceed design limits. Such a valve design does not allow for the possibility of contamination and the consequent tank overpressurization.

Another valve utilizing a diaphragm arrangement for venting a fuel tank was disclosed in U.S. Pat. No. 5,054,508 (Benjey). This valve, however, has no mechanism to relieve tank pressure should contamination or malfunction prevent normal operation.

SUMMARY OF THE INVENTION

The present invention seeks to overcome the drawbacks of prior art pressure control valves through use of a pressure relief valve. The valve is connected between the fuel filler pipe and the fuel vapor handling device, typically a carbon canister, to allow them to equalize pressure in the event contamination blocks the equalization orifice or the main valve malfunctions.

Thus, the valve of the present invention controls fuel vapor within the fuel tank of an automobile having a filler pipe and a fuel vapor handling apparatus, such as a carbon canister, the valve having a valve body, a conduit means for delivering fuel vapor to the valve from the fuel tank, a routing means for directing fuel vapor through the valve, the routing means sensitive to ambient pressure in the filler pipe, sensing means for directing ambient pressure of the filler pipe to the valve to aid the routing means in controlling fuel vapor flow through the valve, duct means for conveying fuel vapor from the valve to the fuel vapor handling apparatus, and bypass means for conveying fuel vapor between the filler pipe and the fuel vapor handling apparatus should the routing means fail to rout fuel vapor from the fuel tank through the valve to the fuel vapor handling apparatus.

Thus, an object of the present invention is to provide an improved tank vapor vent valve which more effectively controls tank pressure.

Another object of the present invention is to provide a tank pressure control valve which contains a pressure relief valve which relieves tank pressure in the event of valve contamination.

Yet another object of the present invention is to provide a tank pressure control valve that prevents overfilling of the fuel tank during refueling.

Still another object of the present invention is to provide a tank pressure control valve that routes fuel vapor to a vapor collection device for handling.

A further object of the present invention is to provide a fuel vapor vent valve which utilizes filler pipe ambient pressure to control venting of the fuel tank.

DETAILED DESCRIPTION OF THE PREFERRED EMBODIMENT

Figure 1:
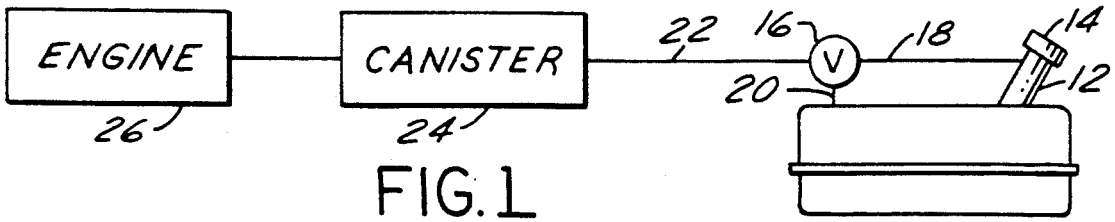
FIG. 1 is a schematic of a fuel supply system showing a valve according to the present invention.

Referring now to FIG. 1, a schematic diagram of a fuel system is shown containing a tank pressure control valve 16 of the present invention. A fuel tank 10 has filler pipe 12 with gas cap 14. Sensing line 18 connects filler pipe 12 with valve 16. Tank vent line 20 routes tank pressure to valve 16 and canister line 22 routes fuel vapor from valve 16 to carbon canister 24. Fuel vapor is processed through canister 24 before being routed to engine 26 for combustion.

Figure 2:
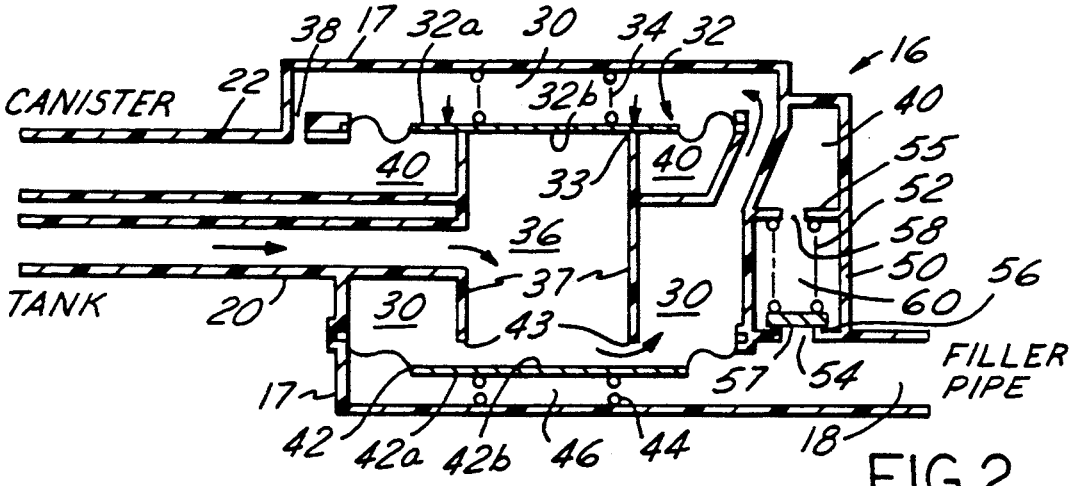
FIG. 2 is a schematic of the vent control valve according to the present invention showing vapor flow through the valve with the gas tank cap removed during filling.

A schematic view of valve 16 is shown in FIG. 2. Signal line 18 from filler pipe 12 leads into chamber 46, located at the bottom of valve 16. Chamber 46 is formed by valve body 17 and side 42*a* of diaphragm 42. Spring 44 presses the bottom of diaphragm 42, side 42*a*, urging it towards seat 43. Side 42*b* of diaphragm 42 adjoins tank chamber 36 and chamber 30, both of which are above diaphragm 42. When diaphragm 42 is pressed onto seat 43 by spring 44, fuel vapor cannot flow between chambers 30 and 36. However, when diaphragm 42 lifts off seat 43, chamber 30 and 36 are in fluid communication.

Diaphragm 32 is bounded by chamber 30 on side 32*a* at the top of valve 16 and by chambers 36 and 40 on side 32*b*. Chamber 40 is connected to canister 24 by line 22 and thus is nominally at atmospheric pressure. Chamber 36 is connected to fuel tank 10 by line 20 and thus operates at tank pressure. Chamber 40 extends around and is concentric with chamber 36. Spring 34 is positioned at the top of valve 16 between valve body 17 and side 32*a* of diaphragm 32 urging it towards seat 33. Side 32*b* of diaphragm 32 adjoins tank chamber 36 and chamber 40. When diaphragm 32 is pressed onto seat 33 by spring 34 (the closed position), fuel vapor cannot flow from chamber 36 to chamber 40. However, when diaphragm 32 lifts off seat 33 (the open position), chamber 36 and 40 are in fluid communication. Orifice 38 provides a gradual means for chamber 30 to equalize pressure with chamber 40.

Figure 3:
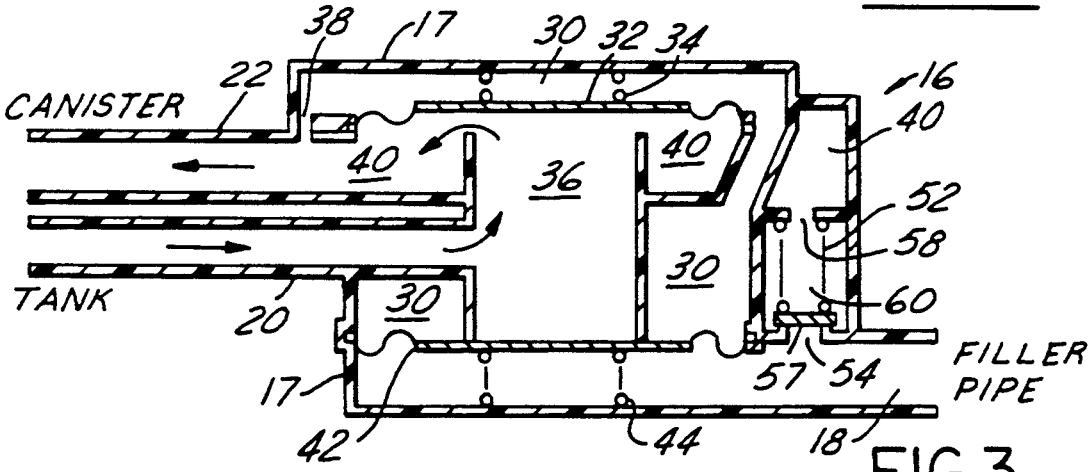
FIG. 3 is a schematic of the vent control valve according to the present invention showing vapor flow through the valve with the gas tank cap in place when tank pressure becomes greater than a predetermined amount.
Figure 4:
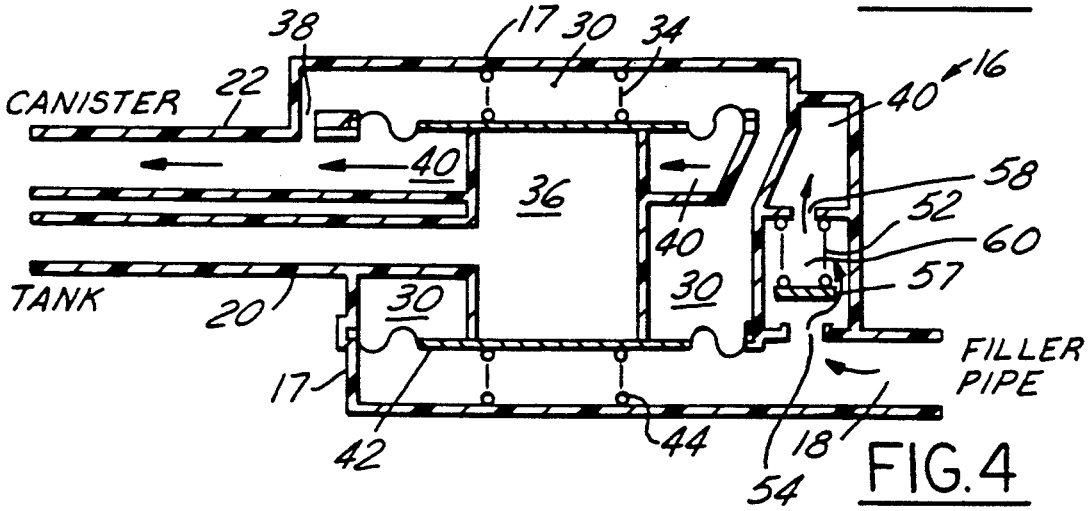
FIG. 4 is a schematic of the vent control valve of according to the present invention showing vapor flow through the poppet valve should contamination block a pressure equalization orifice.

A pressure relief valve 50, preferably a poppet valve, is positioned between chamber 40 and sensing line 18 on the right side of valve 16 in FIGS. 2, 3 and 4. Pressure relief valve 50 will serve essentially as a bypass of valve 16 should orifice 38 become contaminated or clogged, or should valve 16 malfunction. Popper valve 50 consists of a spring 52 positioned between poppet 54 and ledge 55, which biases poppet 54 toward seat 56. Operation of poppet valve 50 is further explained below.

Operation of valve 16 during refueling is depicted by arrows in FIG. 2 showing flow of fuel vapor. When gas cap 14 is removed for refueling, the pressure in sensing line 18 becomes atmospheric allowing chamber 46 to decay to atmospheric. As fuel fills tank 10, tank pressure rises due to a decrease in fuel vapor volume. Tank vapor pressure in chamber 36 exerts pressure on flexible diaphragm 42 and, when sufficient to overcome the restraining force of spring 44, allows diaphragm 42 to lift from its seat, exposing chamber 30 to tank pressure. Diaphragm 32 is then exposed to tank pressure on both sides. However, because the area of diaphragm side 32*a* adjacent chamber 30 exposed to tank pressure is greater than the area of diaphragm side 32*b* adjacent chamber 36 which is also at tank pressure, diaphragm 32 remains seated and fuel vapor does not pass through line 22 to canister 24. As fuel continues to enter tank 10, tank pressure rises until it causes fuel to back up into the filler pipe 12 consequently shutting off the fuel nozzle (not shown). Thus, containing fuel vapor within the fuel tank during refueling contributes to prevention of tank overfill.

During operation of the vehicle, filler pipe 12 is capped with gas cap 14. Filler pipe 12 and sensing line 18 equalize at tank pressure. Thus, chamber 36 and chamber 46 are both at tank pressure. Diaphragm 42 returns to seat 43 since tank pressure exists on both side 42*a* and side 42*b*, and spring 44 thus forces it to the closed position (seated on seat 43). Both diaphragms, 32 and 42, are in the closed position (not shown) and seated on seats 33 and 43, respectively.

If vapor pressure within tank 10 increases, the pressure within chamber 36 also increases. The pressure in chamber 30, which rises to tank pressure during refueling, gradually depressurizes to atmospheric pressure through orifice 38, chamber 40, line 22 and canister 24. When tank 10 pressure, and consequently chamber 36 pressure, rises so that the resulting force on side 32*b* of diaphragm 32 is such that it can overcome the opposing force of spring 34, diaphragm 32 lifts off seat 33. FIG. 3. Chamber 36 and chamber 40 are then unobstructedly connected and fuel vapor can flow through line 22 to canister 24 where it is handled appropriately.

Contamination from tank 10 or from the fuel itself may cause blockage in the narrow passageway of orifice 38. When this occurs, the pressure chamber 30 (which had risen to tank pressure) cannot gradually be reduced its pressure through orifice 38, chamber 40, line 22 and canister 24. As such, chamber 30 will remain at the tank pressure which existed in tank 10 when gas cap 14 was replaced on filler pipe 12 after refueling. This pressure, which acts on the full area of side 32*a* of diaphragm 32, may be sufficient to keep diaphragm 32 from opening during vehicle operation since it acts in conjunction with spring force 34 in resisting opening of diaphragm 32. Pressure relief valve 50 provides a means for tank 10 pressure to be routed to canister 24 in the event of orifice 38 contamination. The operation of pressure relief valve 50 is depicted in FIG. 4. Pressure in line 18, which will equal that of tank 10 during vehicle operation, acts on face 57 of poppet 54 resulting in an upward force. When that resulting force is sufficient to overcome the opposite acting force of spring 52, poppet 54 lifts off seat 56 allowing fuel vapor to pass from line 18 into chamber 60, through passage 58, into chamber 40, and through line 22 to canister 24. As such, overpressurization of tank 10 is avoided and tank 10 fuel vapor is handled adequately. The opposing force of spring 52 is appropriately set so as not to interfere with normal operation of valve 16. Pressure relief valve 50 can be positioned within valve 16 as shown in FIG. 4, or can be located on the outside of valve body 17. Passage 58 is sized appropriately so that it can handle a sufficient volume of fuel vapor flow to adequately relieve tank pressure.

Although the preferred embodiment of the present invention has been disclosed, various changes and modifications may be made without departing from the scope of the invention as set forth in the appended claims.

What is claimed is:

1. A valve for controlling the pressure of fuel vapor within the fuel tank of an automobile having a filler pipe, said valve connected to a fuel vapor handling apparatus, said valve comprising a valve body, conduit means for delivering said fuel vapor to said valve from said fuel tank, routing means within said valve body for directing flow of said fuel vapor through said valve with said routing means sensitive to ambient pressure in said filler pipe, sensing means for directing ambient pressure of said filler pipe to said valve to aid said routing means in controlling fuel vapor flow through said valve, duct means for conveying said fuel vapor from said valve to said fuel vapor handling apparatus, and bypass means for conveying fuel vapor between said filler pipe and said fuel vapor handling apparatus when said routing means fails to rout fuel vapor from said fuel tank through said valve to said fuel vapor handling apparatus.

2. A valve according to claim 1 wherein said routing means further comprises flow blocking means movable to an open position to allow fuel vapor to flow from said conduit means to said duct means when pressure in said conduit means is equivalent to pressure in said sensing means, said flow blocking means movable to a closed position to prevent fuel vapor from flowing from said conduit means to said duct means when atmospheric pressure is present in said sensing means, and flow governing means movable to an open position when atmospheric pressure is present in said sensing means to allow fuel vapor to flow from said conduit means into a chamber adjacent said flow blocking means such that fuel tank pressure acts upon said flow blocking means to urge said flow blocking means to a closed position, said flow governing means movable to a closed position to prevent fuel vapor from flowing from said conduit means to said chamber when pressure in said conduit means is equivalent to pressure in said sensing means.

3. A valve according to claim 2 wherein said flow blocking means is a first diaphragm movably attached to a first outlet from a cell in communication with said conduit means, said first diaphragm able to block or allow flow from said first outlet of said cell to said duct means.

4. A valve according to claim 3 wherein said flow governing means is a second diaphragm movably attached to a second outlet from said cell, said second diaphragm able to block or allow flow from said second outlet of said cell to said chamber, said chamber in fluid communication with said duct means through an orifice which allows pressure in said chamber to bleed into said duct means.

5. A valve according to claim 4 wherein said bypass means is a poppet valve connected between said duct means and said sensing means, said poppet valve having a poppet biased to shut toward said sensing means, said poppet able to lift off a seat allowing flow through said valve when pressure within said sensing means overcomes the force of a biasing element.

6. A valve according to claim 5 wherein said biasing element is a spring.

7. A valve according to claim 6 wherein said poppet valve is contained within said valve body.

8. A valve according to claim 4 wherein said first diaphragm and said second diaphragm have means to bias said diaphragms to a position which blocks flow from said cell.

9. A valve according to claim 8 wherein said means to bias is a spring.

10. A valve according to claim 9 wherein said fuel vapor handling apparatus is a charcoal canister.

11. A valve according to claim 10 wherein said fuel vapor handling apparatus is a carbon canister.

12. An automobile fuel system having a fuel tank, a filler pipe allowing flow into said fuel tank, a gas cap to open and close said filler pipe, a canister for handling fuel vapor from said fuel tank, and a control valve for routing fuel vapor from said fuel tank to said canister, said control valve comprising:

a valve body;

conduit means for delivering said fuel vapor to said valve from said fuel tank;

routing means within said valve body for directing flow of said fuel vapor through said valve with said routing means sensitive to ambient pressure in said filler pipe;

sensing means for directing ambient pressure of said filler pipe to said valve to aid said routing means in controlling fuel vapor flow through said valve;

duct means for conveying said fuel vapor from said valve to said canister and bypass means for conveying fuel vapor between said filler pipe and said canister when said routing means fails to rout fuel vapor from said fuel tank through said valve to said canister.

13. A valve according to claim 12 wherein said routing means further comprises:

flow blocking means movable to an open position to allow fuel vapor to flow from said conduit means to said duct means when pressure in said conduit means is equivalent to pressure in said sensing means, said flow blocking means movable to a closed position to prevent fuel vapor from flowing from said conduit means to said duct means when atmospheric pressure is present in said sensing means, and flow governing means movable to an open position when atmospheric pressure is present in said sensing means to allow fuel vapor to flow from said conduit means into a chamber adjacent said flow blocking means such that fuel tank pressure acts upon said flow blocking means to urge said flow blocking means to a closed position, said flow governing means movable to a closed position to prevent fuel vapor from flowing from said conduit means to said chamber when pressure in said conduit means is equivalent to pressure in said sensing means.

14. A valve according to claim 13 wherein said flow blocking means is a first diaphragm movably attached to a first outlet from a cell in communication with said conduit means, said first diaphragm able to block or allow flow from said first outlet of said cell to said duct means.

15. A valve according to claim 14 wherein said flow governing means is a second diaphragm movably attached to a second outlet from said cell, said second diaphragm able to block or allow flow from said second outlet of said cell to said chamber, said chamber in fluid communication with said duct means through an orifice which allows pressure in said chamber to bleed into said duct means.

16. A valve according to claim 15 wherein said bypass means is a poppet valve connected between said duct means and said sensing means, said poppet valve having a poppet biased to shut toward said sensing means, said poppet able to lift off a seat allowing flow through said valve when pressure within said sensing means overcomes the force of a biasing element.

17. A valve according to claim 16 wherein said biasing element is a spring.

18. A valve according to claim 17 wherein said poppet valve is contained within said valve body.

19. A valve according to claim 18 wherein said fuel vapor handling apparatus is a carbon canister.

* * * * *